US005711159A

United States Patent [19]

Whipple, III

[11] Patent Number: 5,711,159

[45] Date of Patent: Jan. 27, 1998

[54] ENERGY-EFFICIENT REFRIGERATOR CONTROL SYSTEM

[75] Inventor: Walter Whipple, III, Amsterdam, N.Y.

[73] Assignee: General Electric Company, Schenectady, N.Y.

[21] Appl. No.: 647,345

[22] Filed: May 9, 1996

Related U.S. Application Data

[63] Continuation of Ser. No. 301,764, Sep. 7, 1994, abandoned.

[51] Int. Cl.[6] ..... F25D 17/04; F25D 11/02

[52] U.S. Cl. ..... 62/82; 62/186; 62/441

[58] Field of Search ..... 62/186, 82, 228, 62/4, 180, 408, 441; 165/294, 296

[56] References Cited

U.S. PATENT DOCUMENTS

| | | | |
|---|---|---|---|
| 4,122,687 | 10/1978 | McKee | 62/156 |
| 4,481,787 | 11/1984 | Lynch | 62/180 |
| 4,910,972 | 3/1990 | Jaster | 62/335 |
| 4,918,942 | 4/1990 | Jaster | 62/335 |
| 5,103,650 | 4/1992 | Jaster | 62/198 |
| 5,134,859 | 8/1992 | Jaster | 62/503 |
| 5,255,530 | 10/1993 | Janke | 62/288.4 |
| 5,357,765 | 10/1994 | Thomas et al. | 62/187 |
| 5,428,965 | 7/1995 | Grunwald et al. | 62/180 |

OTHER PUBLICATIONS

Donald E. Knoop et al., "An Adaptive Demand Defrost and Two-Zone Control and Monitor System for Refrigeration Products," IEEE Transactions on Industry Applications, vol. 24, No. 2, Mar./Apr. 1988, pp. 337–342.

*Primary Examiner*—William E. Wayner
*Attorney, Agent, or Firm*—Donald S. Ingraham

[57] ABSTRACT

An energy-efficient refrigerator includes a refrigerator control system for generating refrigerator control signals responsive to cooling demands of respective refrigerator compartments; a refrigeration apparatus coupled to the control system; and a multiplex damper system disposed to selectively direct the cooling-air from the refrigeration apparatus to compartments in response to the refrigerator control signals. The multiplex damper system comprises a single movable control damper disposed to direct cooling-air flow to a single or multiple compartments. The evaporator and its associated fan and a variable speed compressor are independently controlled by the refrigerator control system. The variable speed compressor typically comprises a continuously variable speed motor such as an electronically commutated motor. The refrigeration control system is coupled to sensors, such as compartment temperature sensors, ambient condition sensors, and compartment access door sensors, so as to determine the cooling demands of respective refrigerator compartments, and generates control signals for the refrigeration apparatus, including, for example, compressor motor speed, evaporator and condenser fan operation, and other control functions.

24 Claims, 1 Drawing Sheet

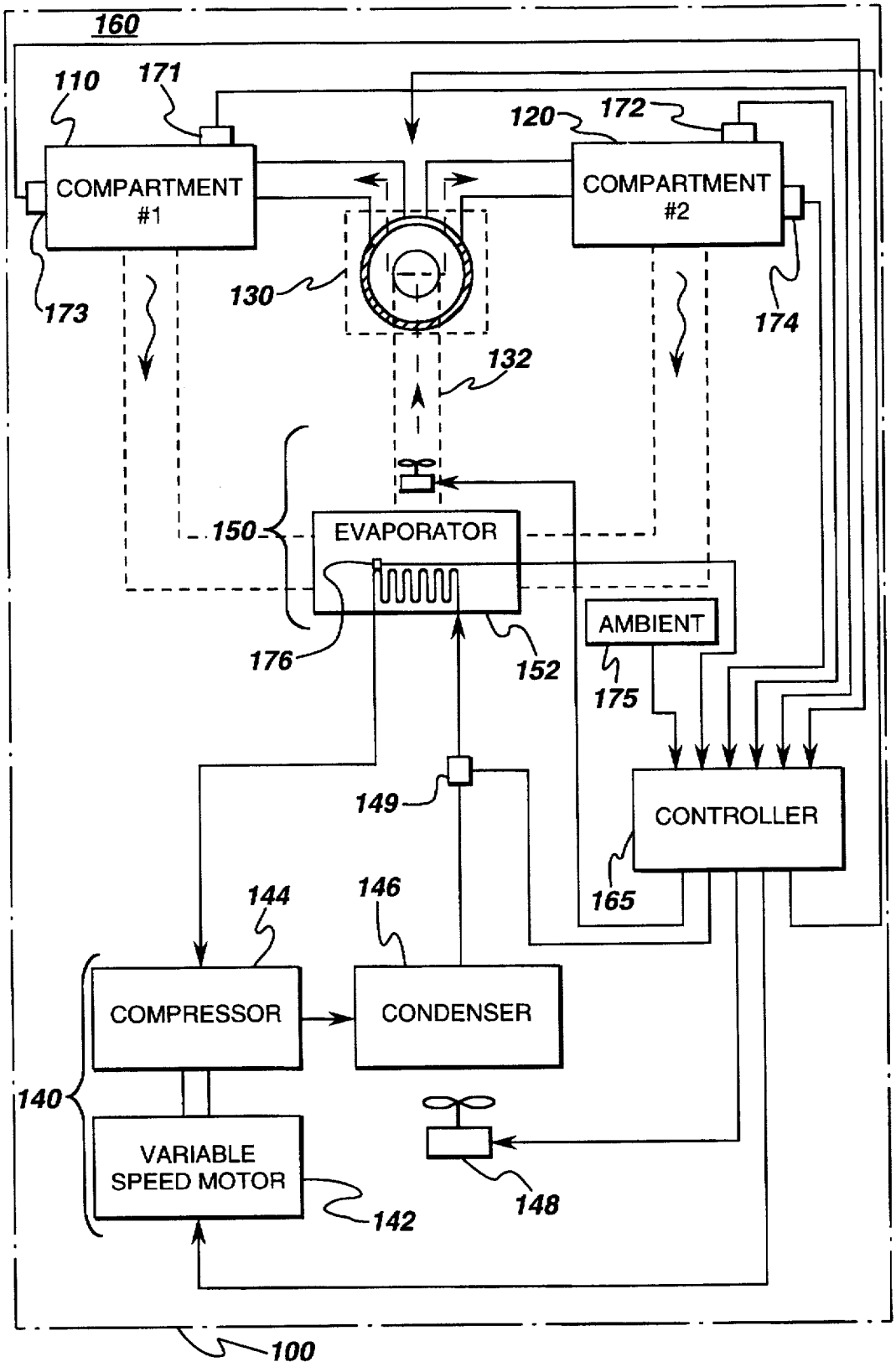
160
110
171
120
172
COMPARTMENT #1
COMPARTMENT #2
173
130
174
132
150
EVAPORATOR
176
152
AMBIENT
175
149
CONTROLLER
165
144
146
COMPRESSOR
CONDENSER
140
VARIABLE SPEED MOTOR
142
148
100

ENERGY-EFFICIENT REFRIGERATOR CONTROL SYSTEM

This application is a Continuation of application Ser. No. 08/301,764, now abandoned filed Sep. 7, 1994.

BACKGROUND OF THE INVENTION

This application is related to application Ser. No. 08/301,761, and refiled as Ser. No. 08/647,346, allowed Nov. 29, 1996, issued fee paid Feb. 14, 1997, filed concurrently herewith and entitled "Refrigerator Multiplex Damper System", which is assigned to the assignee of the present invention and is incorporated herein by reference.

This invention relates generally to refrigerators and in particular to systems for controlling the respective cooling of different compartments within the refrigerator and controlling operation of refrigeration apparatus components to operate in an energy-efficient manner.

In most conventional refrigerators, a need for cooling in one refrigerator compartment results in the operation of the all components in the refrigeration apparatus and the delivery cooling air to both freezer and fresh food compartments in the refrigerator. For example, a thermostatic control detecting a temperature above a set point temperature in one compartment generates a signal to start a compressor, beginning the pumping and compressing of the refrigerant, and simultaneously the evaporator fan is energized to produce air flow over the coils of the evaporator in order to cool the air. The cooled air then commonly passes into a plenum in which the flow is split such that the majority of the air flow is directed into a freezer compartment and the other portion of the air flow is directed into fresh food compartments of the refrigerator. The split of air flow between the freezer and fresh food compartments is made by a damper that directs the majority of the air flow into the freezer compartment; because the air flow is always split between freezer and fresh food compartments, the refrigeration apparatus always chills the cooling air to a sub-freezing temperature, regardless of which compartment (fresh food or freezer) is in need of cooling. In most conventional refrigerators the position of the damper is either fixed at time of manufacture or adjustable within a small range, either manually by the operator or by an automated control within a limited range of adjustment, such that the majority of air flow in all damper settings is still directed to the freezer compartment. In such systems the compressor speed is typically fixed, and is necessarily set at a point that is sufficient to provide sufficient cooling capacity under adverse ambient and operating conditions.

Operation of the refrigerator in this manner results in certain inefficiencies that increase the energy consumption of the refrigerator. For example, the limited range of damper positions results in cooling areas of the refrigerator that may not presently need cooling (e.g., cooling the freezer compartment when the cooling demand is in the fresh food compartment). Further, the setting of the damper position is a trial and error process in which the operator must attempt to achieve a desirable setting for the current operating conditions of the refrigerator (such as load in the respective compartments, ambient conditions around the refrigerator, etc.). Additionally, the simultaneous operation of the single speed compressor (and the associated condenser fan) and the evaporator fan is not necessarily efficient from the standpoint of the refrigeration apparatus because compressor start up typically results in a large refrigerant mass flow rate and high compressor load. For example, system startup in ambient conditions in which the refrigerant in the evaporator is in liquid form (after a shut down period) results in very heavy compressor loads (high refrigerant mass flow rate) because, as the compressor starts and immediately goes to normal operating speed, it draws a suction on the evaporator, reducing the pressure in the evaporator, causing the sizable quantity of refrigerant to quickly flash to vapor and pass into the compressor. This effect is exacerbated by always operating the evaporator fan in conjunction with the compressor because the immediate flow of warm air over the evaporator adds to the conditions resulting in rapid vaporization of the large quantity of refrigerant that had been in the evaporator during the shut down part of the cycle. Further, the split air flow necessitates that the cooling air always be chilled to sub-freezing temperatures sufficient to maintain the freezer at its desired temperature. Yet another area of energy inefficiency in the conventional refrigerator is in the defrost cycle of the freezer, as it involves heating the air around the evaporator to remove the frost, after which it is necessary to remove the heat added to the refrigerator compartments by the defrost cycle.

It is desirable from the standpoint of reducing energy consumption to operate the refrigerator so as to cool only the compartments in which the cooling demand exists and to operate the refrigeration apparatus in a manner that reduces load on the apparatus, and hence work that it must do.

It is thus an object of this invention to provide a refrigerator control system that improves the energy efficiency of the refrigerator through directing cooling-air flow selectively to a compartment or compartments in which a cooling demand exists and through respective independent operation of refrigeration apparatus components to optimize energy consumption of that apparatus.

SUMMARY OF THE INVENTION

In accordance with this invention, an energy-efficient refrigerator having a plurality of compartments cooled to respective temperatures includes a refrigerator control system for generating refrigerator control signals that are responsive to cooling demands in the refrigerator compartments; a refrigeration apparatus coupled to the control system; and a multiplex damper system disposed to selectively direct the cooling-air chilled by the refrigeration apparatus to compartments in response to the refrigerator control signals. The multiplex damper system comprises a single movable control damper mounted in a cooling-air passage such that it can be disposed in a plurality of respective air flow positions, including single compartment-only air flow position and multiple-compartment air flow positions. The refrigeration apparatus components include an evaporator apparatus (comprising a fan disposed to cause airflow past an evaporator heat exchanger) and a variable speed compressor, the speed of which is selected based upon cooling demands determined by the control system. The compressor motor and the evaporator fan are independently controlled by the refrigerator control system. The variable speed compressor typically comprises a continuously variable speed motor such as an electronically commutated motor. The refrigeration apparatus further comprises a condenser coupled to the compressor and the evaporator; such a system typically further comprises a condenser fan that is independently controllable by the refrigeration control system. An expansion device is disposed between the condenser and the evaporator; such a device may comprise a fixed device such as a capillary tube or alternatively a variable expansion valve device that is controllable by the refrigeration control system. The refrigeration control system is coupled to sensors, such as compartment temperature sensors, ambient condition sensors, compartment access door sensors, and refrigerant phase sensors so as to determine the cooling demands of respective refrigerator compartments.

An energy-efficient method of operating a multi-compartment refrigerator having a multiplex damper system and variable speed compressor includes the steps of determining the cooling demand of respective compartments in the refrigerator and generating respective refrigerator control signals in response to the determined cooling demand so as to independently control the operation of a variable speed compressor, and evaporator fan (that may comprise a variable speed fan), the position of a single movable control damper so as to selectively direct cooling-air flow into respective compartment of the refrigerator to optimize energy usage while maintaining a respective selected temperature in each of the compartments. The step of determining the cooling demand of respective compartments includes sensing the temperature of respective compartments, sensing ambient conditions, and sensing compartment access door positions (e.g., open or closed, and time open). The step of respectively controlling the compressor includes selecting a compressor speed in dependence on the temperature of the compartment to be cooled, ambient conditions, and the temperature and phase of the refrigerant that is passing from the evaporator to the compressor. The step of respectively controlling the operation of the evaporator fan includes energizing the fan independent of operating the variable speed compressor. Further, the method of the present invention is readily adapted to controlling other components in the refrigeration apparatus, such as a variable expansion valve.

BRIEF DESCRIPTION OF THE DRAWING

The features of the invention believed to be novel are set forth with particularity in the appended claims. The invention itself, however, both as to organization and method of operation, together with further objects and advantages thereof, may best be understood by reference to the following description in conjunction with the accompanying drawing in which the sole FIGURE is a partial schematic and partial block diagram of a refrigerator having a control system, variable speed compressor, and multiplex damper system in accordance with the present invention.

DETAILED DESCRIPTION OF THE INVENTION

A refrigerator 100 in accordance with this invention comprises a refrigerator control system 160 that is coupled to control various refrigeration apparatus components and a multiplex damper system 130. Refrigerator 100 comprises at least a first compartment 110 and a second compartment 120 that receive cooling-air chilled by the refrigeration apparatus and that flows to the compartment via multiplex damper system 130. Multiplex damper system 130 is disposed in an air supply passage 132 so as to selectively direct cooling-air flow passing from the refrigeration apparatus into either first compartment 110 or second compartment 120, or alternatively to split the cooling-air flow so as to direct some of the flow into first compartment 110 and some of the flow into second compartment 120.

As used herein, "refrigeration apparatus" refers to devices or combinations of devices that are used to chill (that is, reduce the temperature of) air to a temperature sufficiently low to provide the desired temperatures in compartments in refrigerator 100. By way of example and not limitation, such a system comprises a compressor apparatus 140, an expansion device 149, and an evaporator apparatus 150. Compressor apparatus 140 comprises a compressor 144 that is driven by a variable speed motor 142. Variable speed motor 142 typically is a continuously variable speed motor (that is, adapted to run at any speed within a continuum of speeds) such as an electronically commutated motor, but alternatively may comprise a motor that is adapted to run at multiple (two or more) specific speeds. Compressor 144 is coupled to a condenser 146 such that compressed refrigerant passes from the compressor to condenser 146. Condenser 146 is a heat exchanger in which the refrigerant on one side of the heat exchanger surface is cooled by air or the like circulated over the other side of the heat exchange surface by a condenser fan 148; condenser fan typically comprises a fixed speed electric motor, but alternatively may comprise a variable speed electric motor. Alternatively, the heat exchanger of condenser 146 may comprise a heat exchanger without an associated fan, such as plumbing that is thermally coupled to the skin of refrigerator 100 such that the heat from the refrigerant in the plumbing passes through the refrigerator skin and hence to the ambient atmosphere (such a system is often called a "hot wall" condensed, or other heat exchanger arrangement for rejecting heat to the atmosphere.

Evaporator apparatus 150 comprises an evaporator 152 that is a heat exchanger in which heat from the air to be cooled is circulated across one side of the heat exchanger surface and heat from the air is absorbed by a refrigerant fluid circulating on the other side of the heat exchange surface. The cooling air for the refrigerator compartment is circulated over the heat exchange surfaces by an evaporator fan 154 (fan 154 is illustrated in one position with respect to evaporator 152, but it can be positioned at other locations (not illustrated) in air passage 132 so as to provide the desired cooling-air flow). Evaporator fan 154 typically comprises a single speed electric motor but alternatively may comprises a variable speed or continuous variable speed electric motor. Evaporator 152 is coupled to a compressor 144 such that the heated (and typically now-gaseous) refrigerant fluid flows to compressor apparatus 140 in which the refrigerant is compressed and condensed before being recirculated to the evaporator through expansion device 149. Expansion device 149 typically comprises a capillary tube, an orifice, or the like, or alternatively comprises a variable expansion valve, such as is disclosed in co-pending application entitled "Refrigeration System With Electrically Controlled Expansion Valve", Ser. No. 08/301,762, which is assigned to the assignee herein and is incorporated herein by reference. The refrigerant fluid is a liquid-to-gas phase changing material adapted for a particular refrigeration system; Freon (referring generally to the group halogenated hydrocarbons (usually based on methane) containing one or more fluorine atoms, and which are commonly used as refrigerants), Freon 134A, Freon 134B, propane, butane, or the like are common examples of refrigerants. Alternatively, refrigeration apparatus can comprise an ammonia-based system, a thermoelectric system (not shown), or the like.

By way of example and not limitation, multiplex damper system 130 as illustrated in the FIGURE is disposed in cooling air passage 132 to receive the chilled cooling-air flow and direct that flow into respective refrigerator compartments. Multiplex damper system 130 comprises a single movable control damper (illustrated in the FIGURE by way of example and not limitation in a position that allows chilled air flow simultaneously into compartments 110 and 120) that is adapted to be selectively disposed in a plurality of air flow positions so as to direct cooling-air flow to a desired compartment in refrigerator 100 (air flow passages to respective compartments are shown in phantom in the FIGURE with the arrows therein indicating the direction of flow of cooling air into and out of the respective compartments). In multiplex damper system 130 only the single control damper needs be moved in order to change the cooling-air flow into the refrigerator compartments. The damper is adapted to have positions to direct all air flow to a respective compartment in the refrigerator, to split the air flow between compartments, or an "off" position (no communication between the normal air flow passage from the evaporator to the refrigerator compartments) that can be used when the system is shut down. Alternatively, multiplex damper system 130 can be disposed so as to control the flow of cooling-air returning to the evaporator from the compartments. Details pertaining to the structure and operation of multiplex damper system 130 are disclosed in copending application entitled "Refrigerator Multiplex Damper System", Ser. No. 08/301,761, and refiled as Ser. No. 08/647,346, allowed Nov. 29, 1996, issue fee paid Feb. 14, 1997, which is assigned to the assignee herein and is incorporated by reference.

In accordance with this invention, refrigerator control system 160 comprises a controller 165 that is respectively coupled to multiplex damper system 130, compressor apparatus 140, and evaporator apparatus 150. Controller 165 comprises an analog controller, a digital controller, a microprocessor (also referred to as a micro-controller), or the like which is adapted to determine the cooling demands of respective refrigerator compartments and to generate refrigerator control signals that control and coordinate the operation of multiplex damper system 130, condenser apparatus 140, and evaporator apparatus 150 to optimize refrigerator energy use. For example, controller 165 is typically adapted to generate refrigerator control signals that: i) control the positioning of multiplex damper system 130 in a selected air flow position to control air flow direction through the refrigerator compartments and across evaporator 152; ii) control the operation of evaporator fan 154 independent of the operation of compressor apparatus 140; iii) control the speed of variable speed compressor motor 142; and iv) control the operation of the condenser fan. Controller 165 is additionally readily adapted to provide control functions for other components in the refrigeration apparatus, such as variable speed evaporator fans, variable speed condenser fans, and variable expansion devices.

Controller 165 further comprises sensors to determine the cooling demand of respective compartments in refrigerator 100. Cooling demand is typically determined by temperature measurements, need for defrost, number and duration of door openings of the refrigerator, ambient environmental conditions, or the like. By way of example and not limitation, a temperature sensor 171 is disposed in first compartment 110 and a temperature sensor 172 is disposed in second compartment 120; each temperature sensor 171, 172 is coupled to controller 165 to provide input signals to the controller corresponding to the sensed temperature in the respective refrigerator compartments. A first compartment access-door position sensor 173 and a second compartment access-door position sensor 174 are disposed on the respective refrigerator compartments and coupled to controller 165 to provide input signals to the controller corresponding to access door position (typically, the signal need only correspond to one of two conditions, door open or shut). Additionally, ambient condition sensor 175 is coupled to controller 165 to provide an input signal corresponding to ambient conditions such as temperature and humidity (ambient conditions can be measured directly, or alternatively, can be inferred by other measured parameters, such as compressor run (cycle) time, or compressor speed to maintain a given compartment temperature setpoint, in which case the need for a separate ambient sensor is eliminated; in any event, a signal corresponding to ambient conditions can be generated).

In the example described herein, respective temperature sensors are illustrated in first and second compartments; in alternative embodiments, such as refrigerators having more than two compartments or having sub compartments within other compartments, respective temperature sensors need not be positioned in each respective compartment, such as in arrangements in which cooling-air passes from one compartment into another compartment prior to passing to the evaporator (e.g., a system in which cooling air passes through an ice maker and thence into another freezer compartment). Control system 160 further comprises a refrigerant temperature and phase sensor 176 disposed to sense refrigerant condition as it passes from evaporator 152 into compressor 144. Refrigerant sensor 176 typically is disposed in the evaporator air stream at a point approximately 80% along the path of the refrigerant from the evaporator inlet to outlet. As described more fully below, sensor 176 enables controller 165 to select an optimum speed for compressor motor 142 to meet the cooling demand while minimizing excess energy consumption.

Controller 165 is adapted to generate (e.g., the microprocessor comprises a chip programmed to process input signals to generate the desired output signal) refrigerator control signals based upon input signals from sensors to meet the operational demands of the refrigerator, such as the need to cool a particular compartment (such as fresh food, freezer, or both) or defrost the refrigerator. For example, each compartment temperature sensor 171, 172 is coupled to controller 165 to provide a signal corresponding to the temperature of the respective compartment. Controller 165 typically generates respective differential temperature signals corresponding to the sensed compartment temperature and a set point, or selected, temperature (such selection is typically made by the operator through a temperature selection control associated with the refrigerator); the differential temperature signal corresponds to the cooling demand in the compartment. The differential temperature signals are processed to determine the optimal damper air flow position to meet the cooling demand in the refrigerator and the optimal use of evaporator apparatus and compressor apparatus to minimize energy consumption. Controller 165 can further be adapted to verify a sensed cooling demand, for example by starting the evaporator fan (without starting the compressor) and positioning multiplex damper to recirculate air through the compartment in which the cooling demand has been sensed; if the sensed cooling demand (e.g., temperature difference with respect to a set point) remains after mixing of the air, the compressor is started to meet the cooling demand. Conversely, if the original sensed cooling demand resulted from the addition of a small (warm temperature) item near the temperature sensor, after mixing the air in the recirculation mode, the resultant temperature sensed may not be sufficient to necessitate activation of the compressor.

The respective set point temperatures of first and second compartments in refrigerator 100 are typically selected in the manufacturing process and may be adjustable within certain ranges by the operator. For purposes of describing this invention, and not limitation, the temperatures in typical refrigerator first compartment 110 is maintained at a subfreezing level, and commonly in the range between about −5° F. and +20° F. Second compartment 120, in the typical refrigerator, is maintained at an above-freezing temperature, commonly in the range between 32° F. and 50° F.

In operation, control system 160 receives input signals from temperature sensors 171, 172, access door position sensors 173, 174, and ambient condition sensor 175 and processes these input signals to determine cooling demand.

For example, if the temperature in fresh food compartment (second compartment 120) rises above a set point (such as from the addition of goods in the compartment to be cooled), controller 165 determines that there is a cooling demand in second compartment 120 in response to input signals from temperature sensor 172. In a shutdown condition liquid phase refrigerant accumulates in evaporator 152. Controller 165 generates refrigerator control signals to effect cooling of second compartment which comprise a compressor motor signal to start the compressor at a relatively low speed (e.g., 2400 rpm in a continuous variable speed motor having speeds between 2000 rpm and 4000 rpm) so as to start drawing a suction slowly on the evaporator (that is, reducing the amount of refrigerant stored in the evaporator that begins to flash to vapor, thereby reducing initial compressor loads. In accordance with this invention, operation of evaporator fan 154 is independently controlled so that it is not necessarily energized when compressor 142 is started. In this example situation, keeping evaporator fan 154 off while pumping down the liquid refrigerant in evaporator 152 using a low speed on compressor motor minimizes the vaporization of the refrigerant and thus speeds the pump down of the refrigerant (reducing times by up to 50%) and reduces the work (and energy expended by) of compressor motor 142 as compared to a conventional refrigerator, in which the evaporator fan is energized whenever the compressor is run.

Additionally, controller 165 generates a damper control signal to position multiplex damper system to direct cooling-air flow into second compartment (up to 100% cooling flow into the compartment needing the cooling). After evaporator pump down (based upon modeling data, or alternatively with the addition of historical data for a particular refrigeration apparatus accrued during operation and stored in the controller, or as inferred from sensors such as refrigerant sensor 176, compressor motor torque, or the like) controller 165 generates an evaporator fan signal to start evaporator fan 154 (at a low speed, if evaporator fan 154 is variable speed) so as to create air flow over evaporator 152, resulting in cooling the air passing over the evaporator, which is directed into second compartment 120 (in the example set out above) by multiplex damper system 130. Typically condenser fan 148 is energized simultaneously with compressor motor 142; alternatively, controller 165 can be adapted to operate independently condenser fan 148 of compressor motor 142. Such independent operation can be desirable to minimize perceived noise upon activation of the refrigeration apparatus; alternatively such independent fan activation can be used to control refrigerant head pressure in conjunction with a fixed expansion device 149.

During cooling operation for a given compartment, control system 160 further generates compressor motor control signals to change the speed of compressor motor to optimize refrigerant flow rate for energy efficiency, that is, produce a flow rate that results in nearly all refrigerant being vaporized in a near full evaporator (that is, the evaporator is operating near maximum efficiency as a heat exchanger). For example, the speed of continuously variable speed motor 142 is adjusted in response to refrigerant level signals generated by sensor 176 to produce a refrigerant flow that maintains liquid refrigerant in the evaporator to a point to optimize heat exchanger efficiency. Further, as cooling-air flow can be selectively directed to a given compartment, controller 165 controls compressor apparatus 140 such that, for a given system, the temperature of the refrigerant is maintained about 10° F. less than the set point temperature of the compartment by controlling compressor speed; alternatively, evaporator fan speed can be controlled in addition to compressor speed to optimize energy efficient operation. Such selective control of refrigerant temperature provides reduced energy consumption as the refrigerant is not cooled below an optimal temperature to meet the refrigerator cooling demand, thus reducing the energy consumed by the refrigeration apparatus. Alternatively, in systems having a variable expansion device 149, controller 165 is adapted to control the expansion device to control the wetted area of the evaporator (that is, the proportion of the evaporator filled with liquid refrigerant) and to control variable speed compressor 144 to operate at a speed to meet the cooling demand, that is, produce sufficient refrigerant flow to extract heat from the cooled compartment (such as when quickly chilling a small item, in which the system would see a large temperature differential but require relatively little BTU transfer to effect the cooling).

Cooling of the freezer compartment is desirably accomplished at the completion of an earlier cooling cycle (e.g., fresh food compartment) in order to minimize pump down time to reduce the temperature of the refrigerant sufficiently to create the desired 10° F. temperature differential with the set point temperature. At the conclusion of a cooling cycle, that is, when desired temperature is reached in the cooled compartment, controller 165 typically generates control signals to ramp down the speed of compressor motor 142 to make the shutdown process less audible to the user. Typically, the evaporator fan is operated for about one minute after compressor shutdown to recoup energy from the still liquid refrigerant in the evaporator, a process that also reduces the time to pump the evaporator down at the start of the next cooling cycle and reduces the noise associated with evaporator percolation at the end of the operating cycle when the compressor is stopped. Multiplex damper 130 is typically left in a position at time of shutdown that allows air flow to the compartment that contains the evaporator (e.g., the freezer compartment) to minimize icing of components in the air plenum. Alternatively, the damper can be positioned in an "off" position to restrict natural circulation air flow after shut down of the refrigeration apparatus.

Additionally, the refrigerator control system 160 in accordance with the present invention provides an energy-saving defrost option by selecting a multiplex damper control system air flow position that provides air flow through the fresh food compartment (or other compartments in which the cooling air is at an above-freezing temperature), with compressor apparatus 140 off and the evaporator fan set to a maximum speed, such that the air flow over the evaporator deices the evaporator while still providing cooling to the compartment to which the air flow is directed by the damper assembly. In this arrangement, energy stored in the evaporator ice is used to cool refrigerator compartments during the deice cycle.

Refrigerator 100 may comprise more than first and second compartments, such as an ice maker compartment (not shown), and multiplex damper system 130 is adapted to provide cooling-air flow to each of such compartment.

The control system in accordance with this invention further provides ready capability to control the refrigeration apparatus to improve operation in a number of different operating conditions. For example, signals generated by door position sensors 173 and 174 can be used by controller 165 to optimize compressor motor operation if the compartment door to the compartment being cooled is opened during a cooling operation. In this situation, cold air in the compartment tends to flow towards the floor and over the condenser, causing additional cooling and a consequent drop of head pressure, reducing refrigerant flow into the evaporator; warm air enters the compartment (being cooled at the time) through the open door and is drafted into the evaporator apparatus, resulting in an increased rate of boiling of the refrigerant in the evaporator. This situation in a conventional refrigeration system results in large mass flows into the compressor and a long recovery time (about 20 minutes) to reestablish efficient cooling. In accordance with the present invention, however, in such a scenario, controller 165 would generate a motor control signal to reduce compressor motor speed and reduce the speed of the evaporator fan to minimum (e.g., about 10% or less of normal flow), or alternatively turn off the evaporator fan. After the compartment door is closed, compressor motor speed would be ramped up again and restart the evaporator fan, thereby stabilizing compressor load and energy consumption. As another example of the flexibility and capability of the controller of the present invention, actual operating data (e.g., compressor run times and speeds to maintain a set point temperature in a particular ambient condition) can be used in combination with nominal refrigeration apparatus operating profiles stored in controller 165 so as to determine the need for cleaning of condenser 146, as would be indicated by longer compressor run times to handle a particular cooling load in given ambient conditions.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. An energy-efficient refrigerator having a plurality of compartments cooled to respective temperatures, the refrigerator control system comprising:

a refrigerator control system for generating refrigerator control signals responsive to cooling demands of the respective compartments;

a plurality of refrigeration apparatus components, said components comprising an evaporator apparatus and a variable speed compressor, said components being respectively coupled to said control system and independently controlled thereby so as to collectively cool said plurality of compartments to said respective temperatures;

a multiplex damper system disposed so as to direct the cooling-air flow from said refrigeration apparatus to selected refrigerator compartments, said multiplex damper system being coupled to said refrigerator control system;

said multiplex damper system comprising a single movable control damper mounted in a refrigeration apparatus cooling-air passage such that said control damper is adapted to be selectively disposed in a plurality of respective air flow positions responsive to said refrigerator control signals for controlling cooling-air flow, said respective air flow positions further including an "off" position in which no air flow communication is provided for cooling air passing from said refrigeration apparatus to any of said compartments.

2. The refrigerator of claim 1 wherein said refrigerator comprises at least a first and a second compartment and said plurality of air-flow positions of said multiplex damper system comprises at least a first compartment-only air flow position, a second compartment-only air flow position, and a multiplexed first and second compartment air flow position.

3. The refrigerator of claim 1 wherein said variable speed compressor comprises a continuously-variable speed motor.

4. The refrigerator of claim 3 wherein said evaporator apparatus comprises an evaporator heat exchanger and an evaporator fan, said fan being coupled to said refrigerator control system and responsive to signals generated thereby, said evaporator fan being operable independent of said compressor.

5. The refrigerator of claim 4 wherein said refrigeration apparatus further comprises a condenser assembly, said condenser assembly comprising a condenser heat exchanger and a condenser fan, said condenser fan being coupled to said refrigerator control system and responsive to signals generated thereby, said fan being operable independent of said evaporator fan.

6. The refrigerator of claim 5 wherein said refrigerator control system comprises a controller coupled to a plurality of refrigerator operating condition sensors, said controller further being adapted to generate said refrigerator control signals in response to input signals from said refrigerator operating condition sensors, said controller further being coupled said refrigeration apparatus components so as to provide said refrigerator control signals thereto.

7. The refrigerator of claim 6 wherein said plurality of refrigerator operating condition sensors comprise at least one temperature sensor disposed to sense temperature in respective compartments of said refrigerator.

8. The refrigerator of claim 7 wherein said plurality of refrigerator operation condition sensors further comprise external ambient condition sensors.

9. The refrigerator of claim 7 wherein said plurality of refrigerator operating condition sensors further comprise refrigerator door position sensors.

10. The refrigerator of claim 7 wherein said plurality of refrigerator operating condition sensors further comprise an evaporator to compressor outlet refrigerant phase sensor.

11. The refrigerator of claim 7 wherein said refrigerator control system comprises a microprocessor for processing signals received from said refrigerator operating condition sensor and for generating said refrigerator control signals.

12. The refrigerator of claim 5 wherein said plurality of refrigerator operating condition sensor comprise a respective temperature sensor disposed in each compartment of said refrigerator to be maintained at a respective temperature different from the other compartments in said refrigerator.

13. The refrigerator of claim 4 wherein said evaporator fan comprises a continuously-variable speed motor.

14. The refrigerator of claim 5 wherein said condenser fan comprises a continuously-variable speed motor.

15. The refrigerator of claim 3 wherein said continuously-variable speed motor comprises an electrically commutated motor.

16. An energy-efficient method of operating a multi-compartment refrigerator having a multiplex damper system and a variable speed compressor comprising the steps of:

determining the cooling demand of respective compartment in said refrigerator in a refrigerator control system;

generating respective refrigerator control signals in response to the determined cooling demand so as to independently control the operation of a variable speed compressor, an evaporator fan, and a single movable control damper so as to selectively direct cooling-air flow into respective compartments of said refrigerator to optimize energy usage by said refrigerator in maintaining a respective selected temperature in each of said compartments;

operation of said single movable control damper comprising disposing said damper in one of a plurality of air flow positions, said air flow positions including multiple compartment air flow positions so as to supply cooling air from a common cooling air supply passage.

17. The method of claim 16 wherein the step of determining the cooling demand of respective compartments comprises sensing the temperature of at least one of said compartments.

18. The method of claim 17 wherein the step of determining the cooling demand of respective compartments further comprises sensing ambient conditions external to said refrigerator.

19. The method of claim 18 wherein the step of determining the cooling demand of respective compartments further comprises sensing the position of respective access doors to said respective compartments.

20. The method of claim 18 wherein the step of respectively controlling the operation of said variable speed compressor further comprises determining a selected compressor speed in dependence on the temperature of the compartment to be cooled and refrigerant phase at a measuring site on said evaporator.

21. The method of claim 17 wherein the step of controlling the operation of said single movable control damper comprises disposing said damper in one of a plurality of air flow positions, said air flow positions comprising single compartment-only air flow positions and multiple compartment air flow positions.

22. The method of claim 14 wherein the step of controlling the operation of said evaporator fan comprises energizing said fan independent of operating said variable speed compressor.

23. The method of claim 22 wherein the method of operating said refrigerator further comprises the step of defrosting said refrigerator by positioning said multiplex damper system such that air flow is directed through a respective refrigerator compartment having a set point temperature above freezing and energizing said evaporator fan independent of said compressor such that cooling air flow is circulated around said evaporator to deice said evaporator and into said respective compartment having a set point temperature above freezing.

24. The method of claim 16 wherein the step of determining cooling demand is further dependent upon proximity to completion of a cooling cycle.

* * * * *